US008465229B2

(12) United States Patent
Maconocie et al.

(10) Patent No.: US 8,465,229 B2
(45) Date of Patent: Jun. 18, 2013

(54) OUTER PIPE SLEEVE FOR SEA FLOOR MOORING PILE

(75) Inventors: Alasdair Maconocie, Aberdeenshire (GB); John Oliphant, Edinburgh Lothian (GB); Pierre-Armand Thomas, Puteaux (FR)

(73) Assignee: Technip France, Courbevoie (FR)

( * ) Notice: Subject to any disclaimer, the term of this patent is extended or adjusted under 35 U.S.C. 154(b) by 254 days.

(21) Appl. No.: 12/741,853

(22) PCT Filed: Nov. 7, 2008

(86) PCT No.: PCT/EP2008/065099
§ 371 (c)(1),
(2), (4) Date: Sep. 16, 2010

(87) PCT Pub. No.: WO2009/060049
PCT Pub. Date: May 14, 2009

(65) Prior Publication Data

US 2011/0002742 A1 Jan. 6, 2011

(51) Int. Cl.
*E02D 5/64* (2006.01)

(52) U.S. Cl.
USPC ..... 405/216

(58) Field of Classification Search
USPC ..... 405/211, 216, 224, 227, 255; 52/301; 114/293
See application file for complete search history.

(56) References Cited

U.S. PATENT DOCUMENTS

| | | | | |
|---|---|---|---|---|
| 4,351,624 | A * | 9/1982 | Barber | 405/228 |
| 4,464,083 | A | 8/1984 | Wathey | |
| 5,706,863 | A * | 1/1998 | Matherne et al. | 138/103 |
| 2006/0127187 | A1 * | 6/2006 | Raines | 405/226 |

FOREIGN PATENT DOCUMENTS

| | | | |
|---|---|---|---|
| GB | 1209639 | * | 4/1976 |
| GB | 2 108 556 | A | 5/1983 |
| GB | 2 420 581 | A | 5/2006 |
| JP | 59-170324 | * | 9/1984 |
| JP | 60238525 | A * | 11/1985 |
| WO | WO 98/50640 | A | 11/1998 |
| WO | WO 03/74797 | A | 9/2003 |
| WO | WO 2004/078576 | A | 9/2004 |
| WO | WO 2005/009834 | A | 2/2005 |

OTHER PUBLICATIONS

International Search Report dated Mar. 4, 2009, issued in corresponding international application No. PCT/EP2008/065099.

* cited by examiner

*Primary Examiner* — Sunil Singh
*Assistant Examiner* — Stacy Warren
(74) *Attorney, Agent, or Firm* — Locke Lord LLP

(57) ABSTRACT

The present disclosure provides an improved system and method for increasing an anchoring force on a pile. The concepts regarding the pile can apply whether the pile is degraded and no longer able to support its intended load, or a load on the pile has increased to a level that may overstress the pile. A sleeve can be installed even in subsea conditions over the pile and can be used to provide an additional securing force to the existing pile. The sleeve may include its own padeye for coupling an anchor line or other coupling member to a structure to be secured. The sleeve may also include an assembly of rings coupled together with at least one longitudinal member. The assembly with the rings spaced a distance away from each other may help reduce an installation friction on the sleeve, as it is installed into the sea floor.

25 Claims, 6 Drawing Sheets

OUTER PIPE SLEEVE FOR SEA FLOOR MOORING PILE

CROSS REFERENCE TO RELATED APPLICATIONS

This application is a U.S. national stage of International Application No. PCT/EP2008/065099, filed Nov. 7, 2008, which is a continuation of U.S. Nonprovisional application Ser. No. 11/937,206, filed Nov. 8, 2007.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO APPENDIX

Not applicable.

BACKGROUND

1. Field

The disclosure relates to pile anchor systems and methods, and particularly to pile anchor systems and methods for offshore petroleum structures, such as floating structures, drilling or production risers, and other marine structures.

2. Description of related art

Often marine structures used in offshore petroleum industry are moored to a pile that is anchored to a sea floor. The pile is generally a tubular element that is installed into seabed deposits that form the sea floor. Depending on the depth of the sea at a given location, various methods can be used to install the pile into the sea floor. At great depths, it may be problematic to use a pile-driving hammer or other equipment to install the pile.

A type of pile, known as a suction pile, is particularly suitable for deep water development. Generally, a suction pile is a tubular element with a closed top and open bottom that is installed vertically into the sea floor by self weight penetration and suction pressure. FIG. 1 is a cross-sectional schematic diagram of a pile installed into a sea floor. The suction pile, pile 2, may be installed in the sea floor 4. The pile 2 includes a top 6, sometimes known as a "pile cap," attached to tubular sides 8, and is open at the bottom 10. The top 6 can include a valve 12 that gives access to the interior volume 11 of the pile 2 between the sides 8 and the top 6. The pile 2 further includes a padeye 14. The padeye 14 generally is a reinforced section used to attach an anchor line or other coupling member 16 to a structure (not shown) that may need mooring or otherwise securing. The installation technique generally includes locating the pile 2 in an appropriate location and lowering the pile into the sea floor 4 with cables. Typical the pile will penetrate under its own weight into the seafloor deposits until the resistance from the seabed deposits equals the self weight. Water can then be pumped out of the pile through the value 12 to create a differential pressure in the volume 11 with a net downward force to push the pile to a desired depth of full penetration.

The pile 2 can have different configurations. Some piles may include external fins that extend outwardly from the side. Other piles can include internal baffles or stiffening members that, for example, can be selectively depressurized to position the piles at different angles relative to the sea floor. Some designs have hemispherical tops. Other piles include groups of suction piles coupled together to form an assembly.

A suction pile, driven pile or any other tubular structure penetrated into the seabed to support or resist loads is referred to generally herein as a pile.

Piles can become damaged, worn, or otherwise degraded. Presently, when such piles degraded, the pile is either removed, or abandoned, and another pile is installed at another location near the first pile. In general it is considered that after the initial installation of a pile, the sea floor 4 has been disturbed and the shear resistance around the installed pile may be significantly reduced. Typically, the sea floor deposits 4 may require several months of consolidation and recovery after a pile is installed to provide full strength to the anchoring of the pile in the sea floor deposits.

Further, there are times in which an existing pile may be in a satisfactory condition, but may require to resist additional structural loads from a new design load case or change in design. These new design load cases may overstress or be beyond the capacity of the existing pile. Typically, the solution has therefore been to install an additional pile to provide further support or replace the existing pile. However, the new solution still has the disadvantage of not providing full support until some later time, when the disturbed layers on the sea floor 4 can consolidate around the pile.

Therefore, there remains a need to provide additional support to a pile either in a degraded condition or to provide additional support to extend the capacity of the existing pile.

BRIEF SUMMARY

The present disclosure provides an improved system and method for increasing an anchoring force on a pile. The concepts regarding the pile can apply whether the pile capacity has been degraded and no longer able to support its intended load, or a load on the pile has increased to a level that may overstress the pile. A sleeve can be installed even in subsea conditions over the pile and can be used to provide an additional securing force to the existing pile. The sleeve may include its own padeye for coupling an anchor line or other coupling member to a structure to be secured. The sleeve may comprise a tubular sleeve or include an assembly of rings coupled together with at least one or more longitudinal members. An pile sleeve assembly with rings spaced a distance away from each other can help reduce the installation friction on the sleeve, as it is installed into the sea floor.

The disclosure provides a method for rehabilitating an existing pile installed into a sea floor, comprising: positioning a pile sleeve having a padeye; allowing the pile sleeve to be lowered over the pile; and securing the sleeve to the pile.

The disclosure also provides a rehabilitation system for a subsea an existing pile, installed into a sea floor, the system comprising: a sleeve having a outer shell forming an interior volume and at least partially open on a bottom of the sleeve; a padeye coupled to the sleeve, the padeye having a section of material coupled to the sleeve with an opening disposed through the material; and the sleeve being adapted to be inserted over a pile.

This disclosure in addition provides a rehabilitation system of transferring new or additional loading on the existing pile at a point either at the top, bottom or any selected location between the top and bottom of the pile sleeve system.

BRIEF DESCRIPTION OF THE DRAWINGS

While the concepts disclosed herein are susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art as required by 35 U.S.C. §112.

DETAILED DESCRIPTION

One or more illustrative embodiments of the concepts disclosed herein are presented below. For the sake of clarity, not all features of an actual implementation are described or shown in this application. It is understood that in the development of an actual embodiment, numerous implementation-specific decisions must be made to achieve the developer's goals, such as compliance with system-related, business-related and other constraints, which vary by implementation and from time to time. While a developer's efforts might be complex and time-consuming, such efforts would be, nevertheless, a routine undertaking for those of ordinary skill in the art having benefit of this disclosure.

Figure 1:
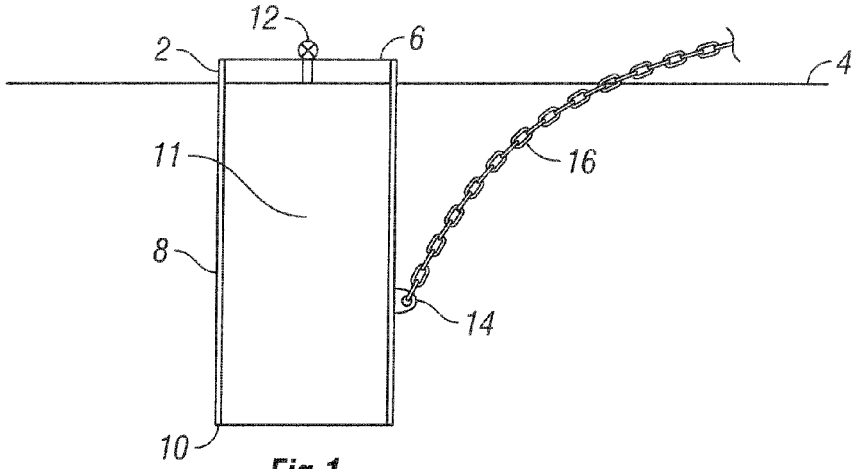
Fig 1 (Prior Art)
FIG. 1 is a cross-sectional schematic diagram of a prior art suction pile installed into a sea floor.
Figure 2:
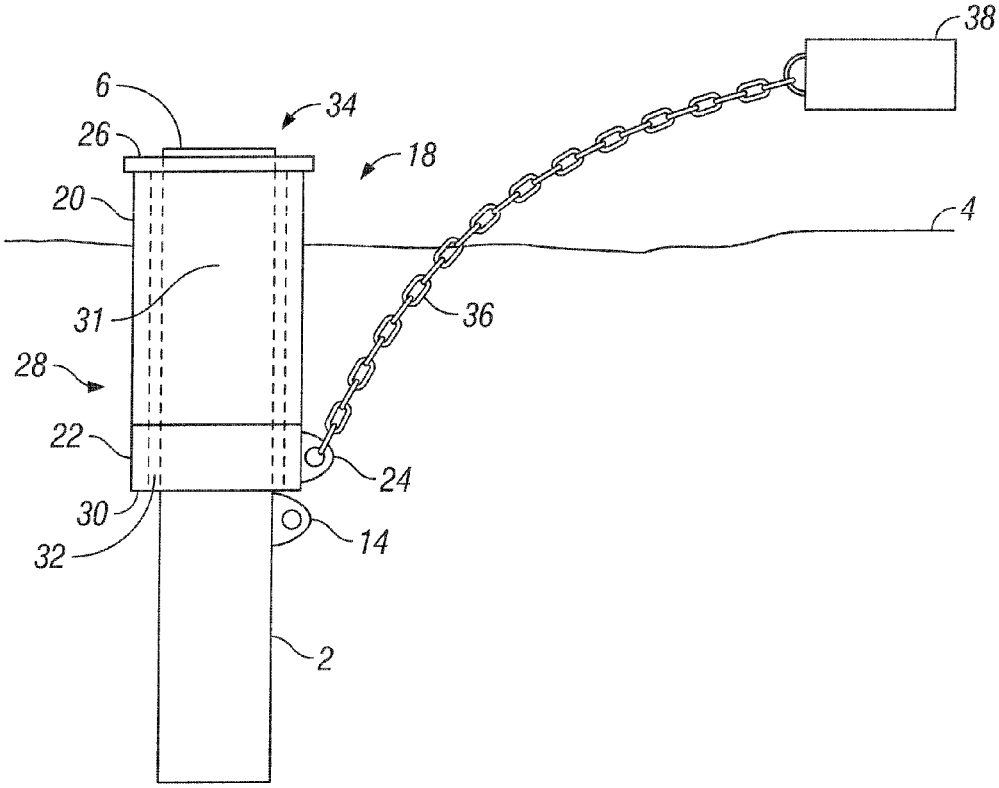
FIG. 2 is a cross-sectional schematic diagram of a system for supporting a pile sleeve installed in a sea floor.

FIG. 2 is a cross-sectional schematic diagram of a system for supporting a pile installed in a sea floor. The pile 2, having a padeye 14, is installed at least partially in a sea floor 4. Due to degraded conditions, additional loading, or other circumstances, the pile 2 may not be suitable for supporting an intended load. A sleeve 20 can be installed over the pile 2 to provide additional support for the load.

The sleeve generally includes a sleeve cap 26 as a top of the sleeve coupled to an outer shell 28 with at least a partially open bottom 30 to form an interior volume 31. The sleeve 10 may generally include a padeye ring 22, which may be integral with or separate from an upper portion of the sleeve 20. The padeye ring 22 generally includes a sleeve padeye 24 coupled thereto. The pile, sleeve, and rings are shown having a circular cross-section. However, it is to be understood that other geometric cross-sections can be used and are contemplated, including square, rectangular, octagonal, hexagonal, elliptical, and other cross-sectional shapes as may be appropriate. Such shapes are included within the term "tubular," "rings," "annular," and other shape-referencing terms used herein. Any annular space 32 formed between the exterior of the pile 2 and the interior of the sleeve 20 can be filled with grout, if desired.

The sleeve 20 can be secured to the pile 2 by a number of methods known to those with ordinary skill in the art. For example, depending on the angle of force exerted on the sleeve, and frictional forces between the sleeve and the pile 2 and/or sea floor 4, the sleeve may be self-securing to the pile. The frictional forces between the sleeve and the pile, or even the sleeve and the sea floor materials, may "lock" the sleeve to the pile, so that relative vertical movement is restrained. In other circumstances, the sleeve may be secured by grouting, adhesives, or other chemical/mechanical means. Still further, a locking system 34 can include welding the sleeve to the pile, inserting a pin through an opening in the sleeve and/or pile, using a threaded nut, or other means. Thus, in at least one embodiment, the sleeve cap 26 can be at least partially open to allow a portion of the pile to extend through the sleeve 20 to lock the sleeve to the pile.

The sleeve may be used to rehabilitate the degraded pile by providing a new coupling location with a new padeye for the coupling member. Further, the sleeve can be used to expand the effective surface area of the pile to provide greater resistance in the sea floor and greater ability to support loads from the coupling member on the pile that is without the sleeve.

A coupling member 36 can be coupled to the sleeve padeye 24. The coupling member 36 can be coupled to a structure 38 such as a tension leg platform, semi-submersible platform, or other structures as may be appropriately moored or otherwise secured to a pile. The coupling member can include, without limitation, cables, chains, and other anchor lines, such as in catenary or taut-line applications, known to those with ordinary skill in the art.

A coupling member 36 can be coupled to the sleeve padeye 24. The coupling member 36 can be coupled to a structure 38 such as a tension leg platform, semi-submersible platform, or other structures as may be appropriately moored or otherwise secured to a pile, such loads exerting tension on the sleeve padeye. The coupling member can include, without limitation, cables, chains, and other anchor lines, such as in catenary or taut-line applications, known to those with ordinary skill in the art.

In some instances, the support provided by the pile 2 may be inadequate for the particular load on the coupling member 36, even with a sleeve 20. To supplement the stability of the pile 2 to provide additional loading, other support structures may be used.

To add the supplementary support, a supplemental pile 40 may be installed at some desired distance from the pile 2. In at least one embodiment, a coupling member 44 can be used with the supplemental pile 40, such as in a lower portion of the pile 40, to provide the additional support to the pile 2 with the sleeve 20. The sleeve 20 can include an additional padeye 43 that provides a coupling location for the coupling member 44 from the sleeve 20 to the pile 40. The coupling member 44 disposed between the sleeve 20 and the pile 40 could be aligned in an opposite direction from the coupling member 36 disposed between the pile 2 and the structure 38. Generally, such supplementary support structures will be positioned at a non-zero angle "a" relative to the coupling member 36, as shown in FIG. 3C, and advantageously between about 90° to about 270°. Alternatively or in addition thereto, if a sleeve 42 is installed on the pile 40, a coupling member 46 may be coupled between the sleeve 20 and the sleeve 42.

Figure 3A:
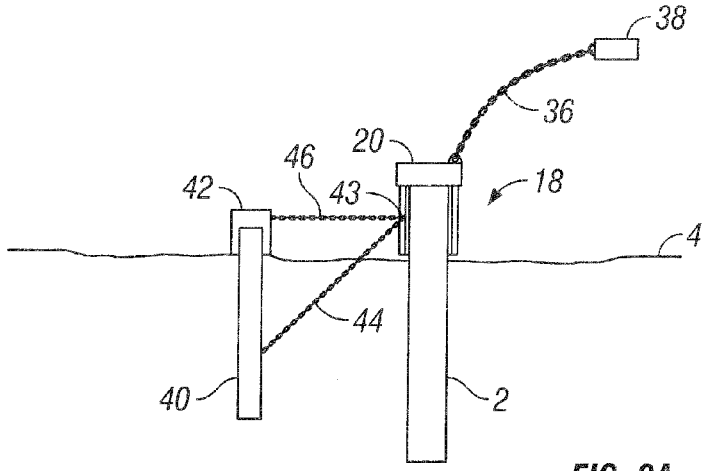
FIG. 3A is a cross-sectional schematic view of the sleeve system with a supplementary support system.
Figure 3B:
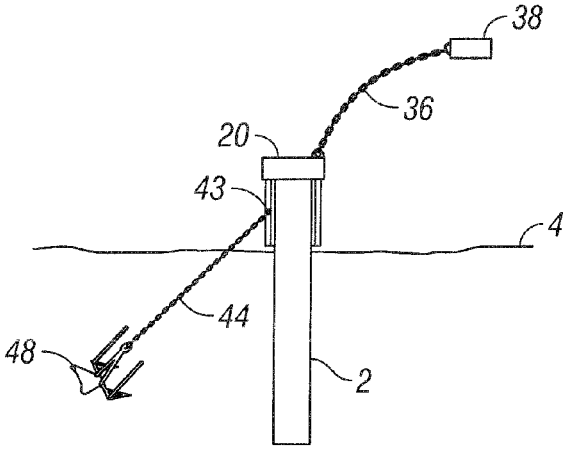
FIG. 3B is a cross-sectional schematic view of an alternative supplementary support system.
Figure 3C:
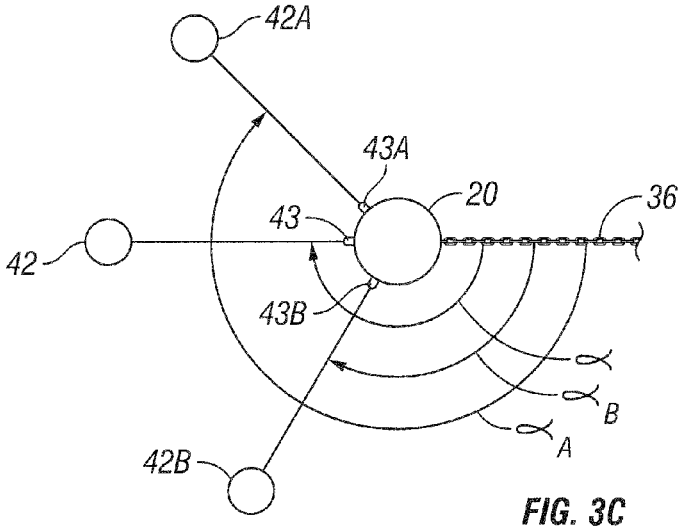
FIG. 3C is a plan schematic view of the supplementary support system.

As shown in FIG. 3B, an anchoring member 48 may be used as an alternative to the supplemental pile 40. The anchoring member 48 may be a structure embedded into the sea floor and generally shaped to provide greater resistance in at least one direction than another. The anchoring member 48 can provide resistance to movement of the pile 2 and the sleeve 20 caused by a force from the coupling member 36. The sleeve 20 may include an additional padeye 43 to couple a coupling member 46 between the sleeve 20 and the anchoring member 48.

If additional piles are installed such as piles 42A, 42B shown in FIG. 3C, then the piles can be installed at some non-zero angle, such as angles αA and αB, respectively. One or more padeyes 43A and 43B, respectively, can be used to couple one or more coupling members to the pile 2 and/or sleeve 20.

Figure 4:
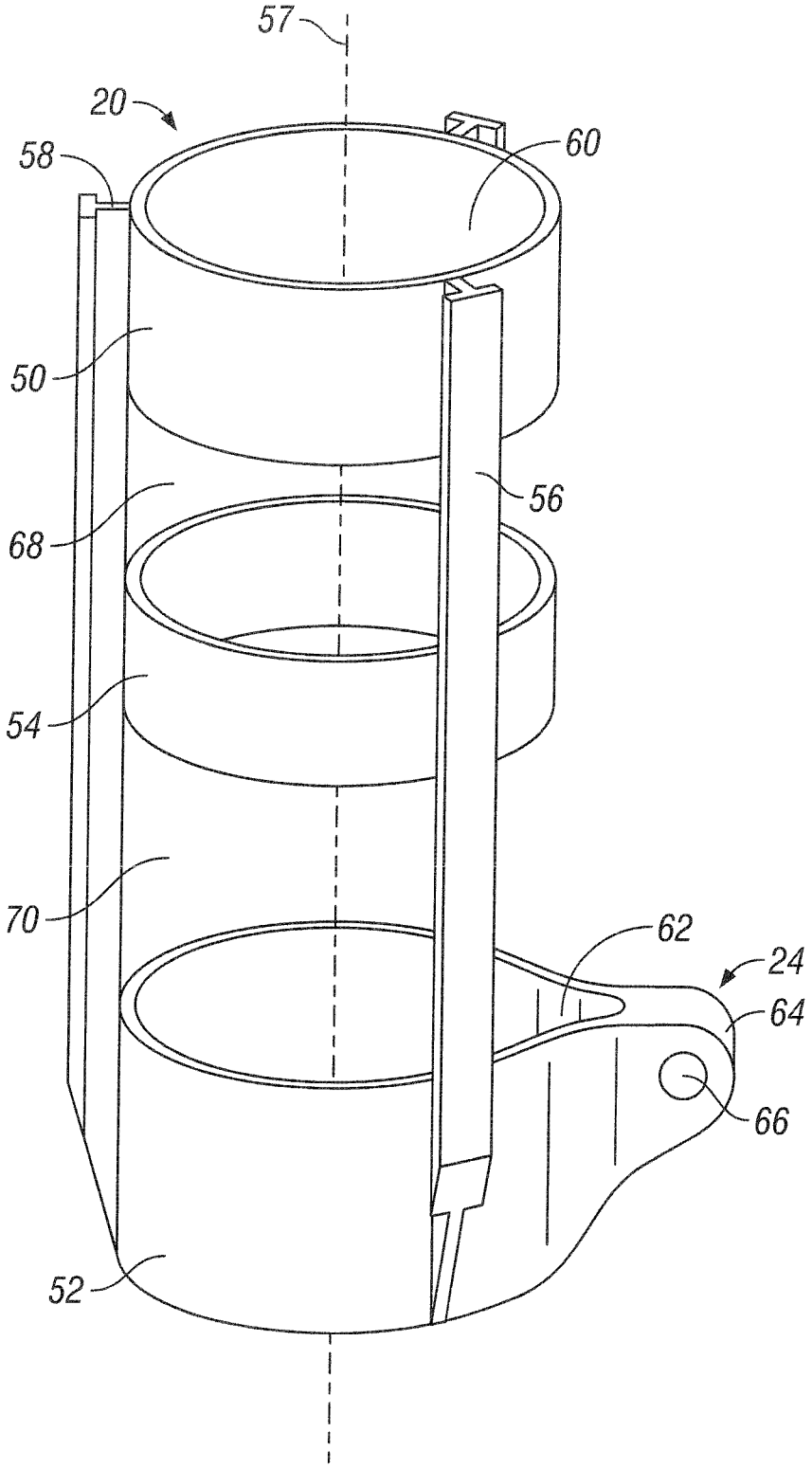
FIG. 4 is a perspective schematic view of another embodiment of the sleeve.

FIG. 4 is a perspective schematic view of another embodiment of the sleeve. The sleeve 20 can include an assembly of two or more rings coupled together with one or more longitudinal members. It is believed that the assembly of the sleeve shown in FIG. 4 is lighter in weight than a correspondingly sized solid outer shell sleeve. The assembly may also provide less friction due to less surface area, as the sleeve is installed over the pile, in surrounding layers of material in the sea floor 4.

More specifically, the sleeve 20 can include an upper sleeve ring 50 and a lower sleeve ring 52 with at least one longitudinal member 56 coupled therebetween. The longitudinal member 56 generally extends outward from the rings by a portion of the longitudinal member 56, herein termed an extension portion 58. The extension portion 58 can include fins, webs portions of formed structures, and so forth. Generally, more than one longitudinal member may be used to support the rings around the sleeve perimeter. For example, three longitudinal members are shown, but the number of longitudinal members can vary from one to many. The longitudinal member 56 may further include a pointed end to help facilitate installation in the sea floor 4 shown in FIG. 2. Further, the longitudinal member may also assist in maintaining rotational alignment as the sleeve is embedded in the sea floor 4 materials. In general, the longitudinal member 56 has sufficient strength to avoid undue bending of the sleeve 20 at least during installation, so that the sleeve will not bind on the pile 2 as it is installed. Further, the sleeve 20 can include an intermediate sleeve ring 54. The intermediate sleeve ring 54 can further assist in maintaining alignment and avoiding buckling of the assembly at least during installation of the sleeve on the pile. A top 60 of the sleeve 20 may be at least partially open. In general, the top is used to limit the amount of travel of the sleeve downward over the piles.

The lower sleeve ring 52 generally includes a padeye 24. The padeye 24 is formed of a section 64 that extends radially outward relative to a longitudinal axis 57 that passes through an inner portion of the rings. The padeye generally has an opening 66 formed therethrough, generally used to couple the coupling member 36 thereto, shown in FIG. 2. In some embodiments, the padeye can further include a padeye clearance portion 62 that is open to the internal portion of the ring 52. The padeye clearance portion 62 can be sufficiently sized, so that the ring 52 can be installed over the original padeye 14 of the pile 2, such as shown in FIG. 2.

The one or more rings 50, 52, 54 are generally spaced a distance from each other in the sleeve 20, shown in FIG. 4. For example, the rings 50, 54 can be separated by a spacing 68, and the rings 54, 52 can be separated by a spacing 70. The spacing, and absence of ring material in the spacing, may provide less friction between the sleeve 20 and the layers of material in the sea floor 4 through which the sleeve is installed.

Figure 5:
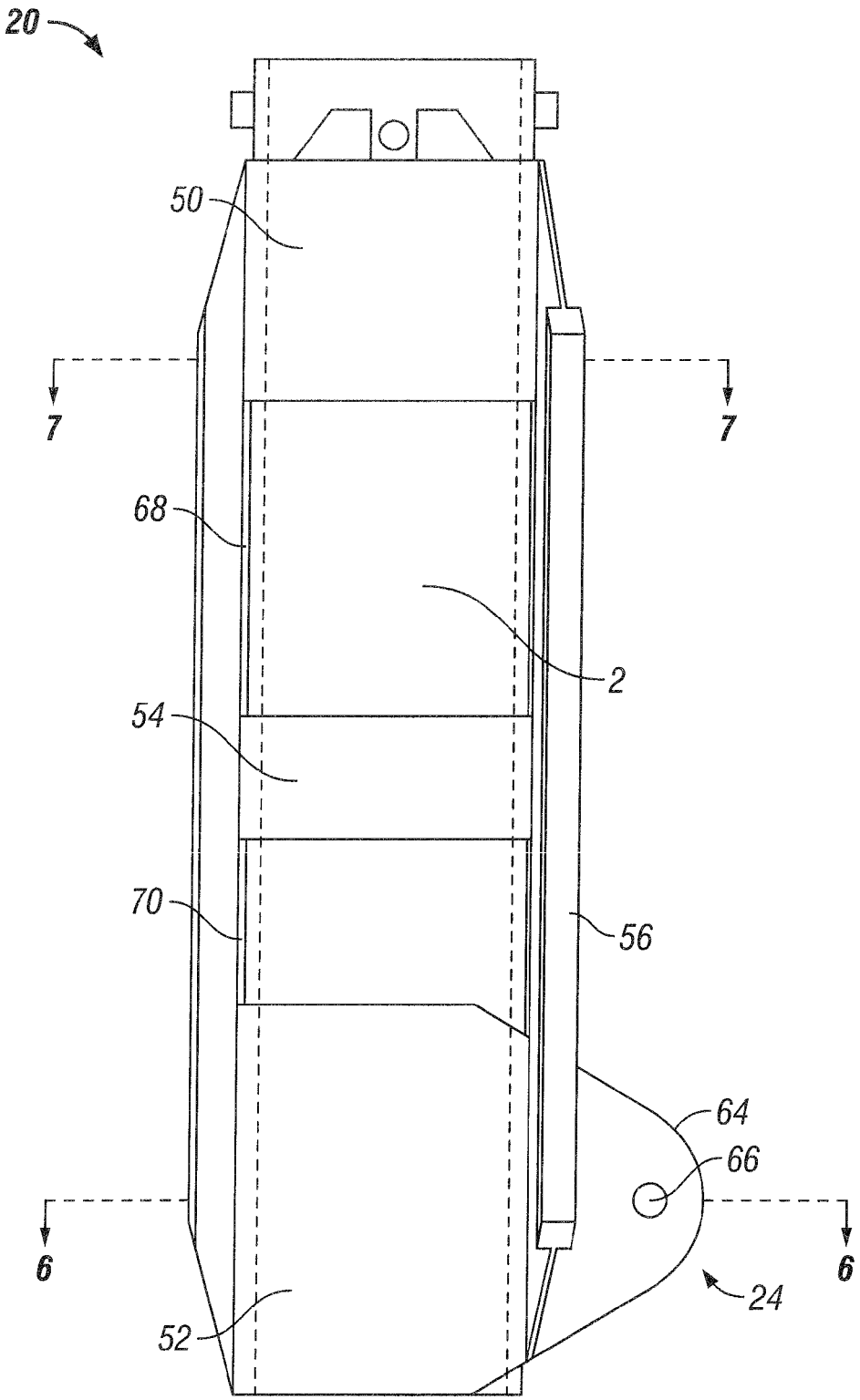
FIG. 5 is a side schematic view of an alternative embodiment of the sleeve shown in FIG. 4.
Figure 7:
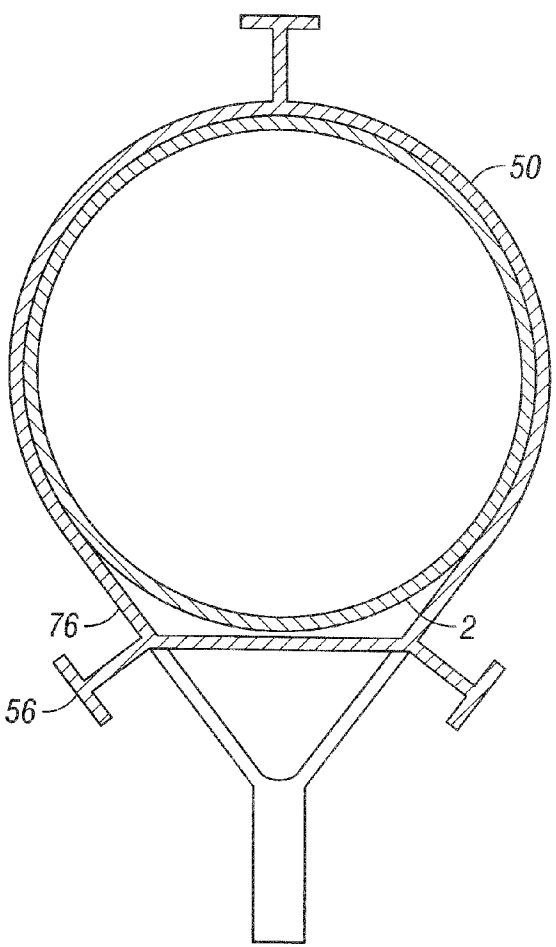
FIG. 7 is a top schematic view of an upper ring shown in FIG. 5.
Figure 6:
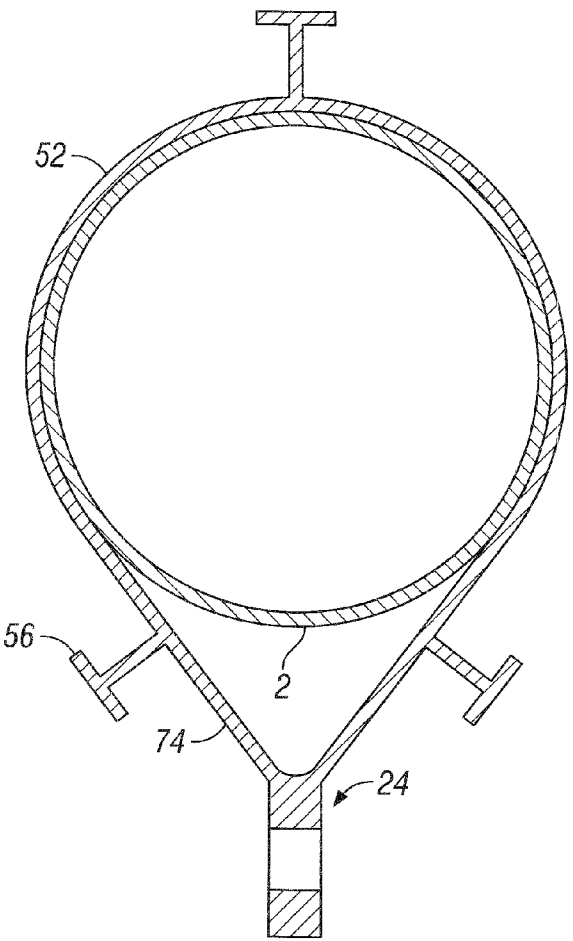
FIG. 6 is a top schematic view of a lower ring shown in FIG. 5.

FIG. 5 is a side schematic view of an alternative embodiment of the sleeve shown in FIG. 4. FIG. 6 is a top schematic view of a lower ring shown in FIG. 5. FIG. 7 is a top schematic view of an upper ring shown in FIG. 5. The drawings will be described in conjunction with each other. Similar elements as described above will be used herein. Generally, the sleeve 20 can include a number of rings, such as rings 50, 52 and 54, coupled together with one or more longitudinal members 56. The spacings 68, 70 between the rings can provide openings to the subsea conditions, and to the sea floor material. A sleeve padeye 24 extends radially outward from the sleeve 20 and is generally coupled to the lower sleeve ring 52. The padeye 24 includes a section 64 and an opening 66 extending therethrough.

As shown in FIG. 6, the lower ring 52 can be extended outwardly relative to the pile 2 with a padeye extension 74 to a suitable radial location for the padeye 24 to be coupled thereto. The pile 2 relative to the ring 52 is shown for reference, but it is understood that other variations are possible and contemplated. In some embodiments, it may be conducive to couple a longitudinal member 56 to the extension 74 on one or both sides of the padeye 24.

As shown in FIG. 7, the upper ring 50, shown disposed about the pile 2 for reference, can include an extension 76 disposed radially outward from the pile. The extension 76 can provide support for the one or more longitudinal members extending to the ring 52 and aligned therewith.

Figure 8:
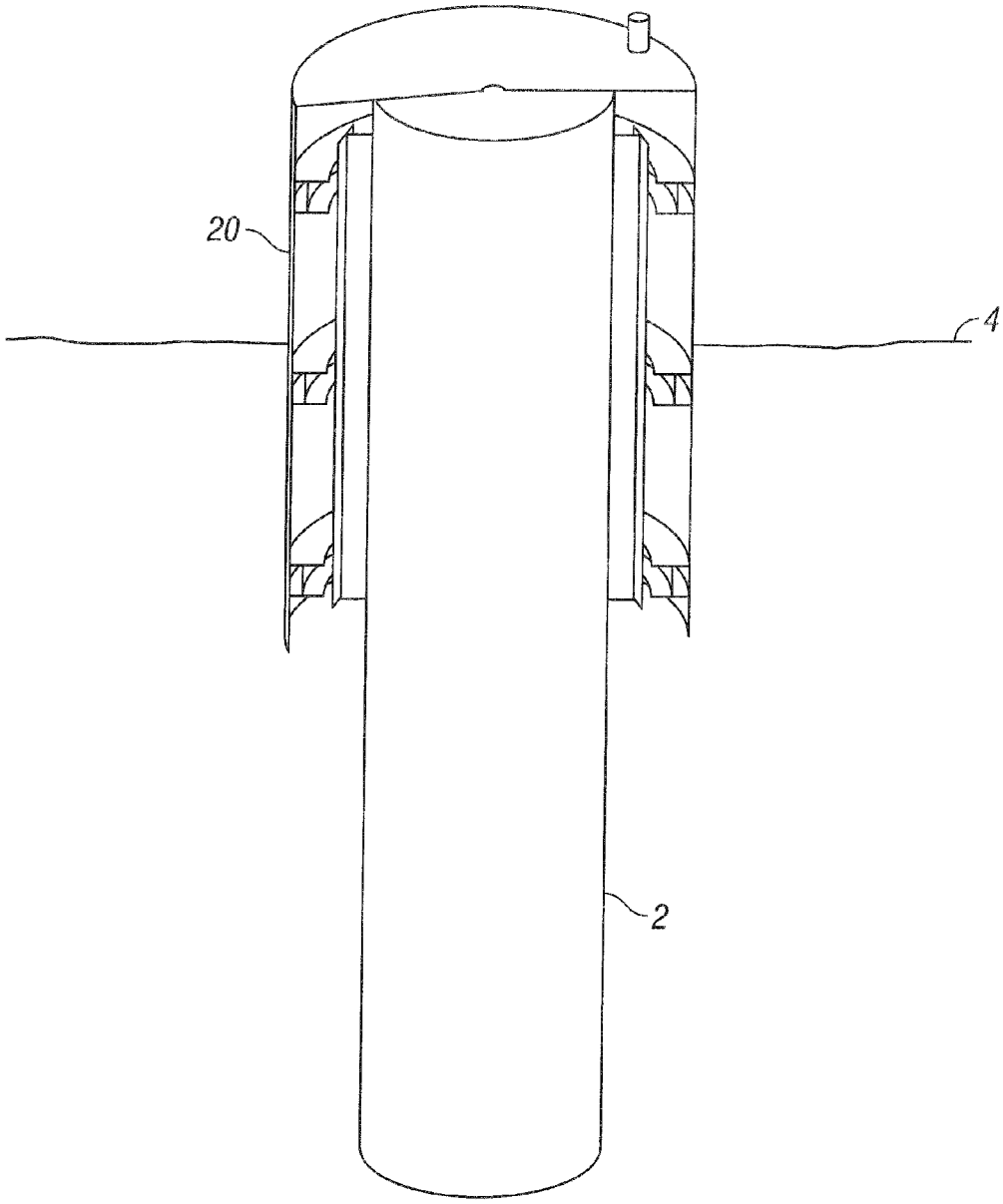
FIG. 8 is a perspective schematic view of another embodiment of the sleeve.

FIG. 8 is a perspective schematic view of another embodiment of the sleeve. In some instances, the sleeve 20 may be completely enclosed, with the exception of the base which is open, should suction pressure be required to drive the sleeve to depth on the pile 2.

In operation, the sleeve 20 can be used to rehabilitate a pile 2 that is installed into the sea floor 4. Generally, the pile would be investigated for a variety of conditions of the pile and a determination made of any degradation that would significantly impact the ability of the pile to support a load, or otherwise indicate that the installation of a sleeve is appropriate. Based on that determination, the sleeve could be installed over the pile.

Generally, the sleeve 20 is positioned adjacent to the pile 2, if the pile was already installed into the sea floor 4. The sleeve padeye 24 is aligned with the pile padeye 14, and the sleeve is allowed to be lowered over the pile. The sleeve can be driven over the pile or lowered over the pile through its own weight. In general, the sleeve is maintained in rotational alignment with the pile, so that the sleeve padeye is in a similar position as a pile padeye after installation. The sleeve then becomes a substitute for the purpose of the pile without necessitating installing a new pile to replace the former pile. If desired, grouting may be installed between the sleeve and the pile. The coupling member can be coupled to the sleeve padeye generally prior to installation over the pile, or, in some circumstances, after installation. If desirable or necessary, the sleeve can be locked to the pile.

In some circumstances, it may be desirable to pre-install the sleeve 20 on the pile 2 prior to installation of the pile into the sea floor 4, such as in a new installation. Such circumstances are envisioned and encompassed with the scope of the present claims and disclosure. For example, it is foreseen that periodic replacements of the pile may be appropriate and a preinstalled sleeve may be easier to replace on a periodic basis starting with the preinstalled sleeve.

The systems and methods herein have been described in the context of various embodiments and not every embodiment has been described. Apparent modifications and alterations to the described embodiments are available to those of ordinary skill in the art. The disclosed and undisclosed embodiments are not intended to limit or restrict the scope or applicability of the concepts of the Applicants, but rather, in conformity with the patent laws, Applicants intend to protect all such modifications and improvements to the full extent that such falls within the scope or range of equivalent of the following claims.

The various methods and embodiments of the concept may be included in combination with each other to produce variations of the disclosed methods and embodiments, as would be understood by those with ordinary skill in the art, given the understanding provided herein. Also, various aspects of the embodiments could be used in conjunction with each other to accomplish the understood goals of the disclosure. Also, the directions such as "top," "bottom," "left," "right," "upper," "lower," and other directions and orientations are described herein for clarity in reference to the figures and are not to be limiting of the actual device or system or use of the device or system. Unless the context requires otherwise, the word "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof Discussion of singular elements may include plural elements and vice-versa. References to at least one item followed by a reference to the item may include one or more items. The device or system may be used in a number of directions and orientations. The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, directly or indirectly with intermediate elements, one or more pieces of members together and may further include without limitation integrally forming one functional member with another in a unity fashion. The coupling may occur in any direction, including rotationally.

The order of steps may occur in a variety of sequences unless otherwise specifically limited. The various steps described herein may be combined with other steps, interlineated with the stated steps, and/or split into multiple steps. Additionally, the headings herein are for the convenience of the reader and are not intended to limit the scope of the concept. Other and further embodiments utilizing one or more aspects of the concepts described above may be devised without departing from the spirit of Applicants' disclosure. For example, other types of piles could be used and some piles could have different types of padeyes or even no padeyes. Other variations are contemplated given the teachings of the disclosure herein.

Further, any references mentioned in the application for this patent, as well as all references listed in the information disclosure originally filed with the application, are hereby incorporated by reference in their entirety to the extent such may be deemed essential to support the enabling of the concept. However, to the extent statements might be considered inconsistent with the patenting of the concept, such statements are expressly not meant to be considered as made by the Applicant(s).

What is claimed is:

1. A method for rehabilitating an existing subsea pile, having at least a portion of a pile padeye, the subsea pile installed into a sea floor and having a top portion, comprising:

positioning a sleeve for installation about the existing subsea pile, the sleeve having an outer surface with a sleeve padeye coupled thereto, an interior volume and an at least partially open bottom;

positioning the bottom of the sleeve over the top portion of the pile;

aligning the sleeve padeye with the at least a portion of the pile padeye; and installing the sleeve about the pile while maintaining an alignment between the sleeve padeye and the at least a portion of the pile padeye so that the top portion of the pile is disposed within or above the interior volume of the sleeve, the sleeve padeye being configured to support a tension load at an angle to a longitudinal axis through the sleeve to supplement or replace a tension load on the pile padeye.

2. The method of claim 1, wherein maintaining alignment further comprises guiding the sleeve into the sea floor with at least one longitudinal member extending outwardly from the sleeve.

3. The method of claim 1, further comprising securing the sleeve to the pile after the pile is installed into the sea floor.

4. The method of claim 1, further comprising:

investigating a condition of the existing subsea pile;

determining a degraded condition of the pile; and installing the sleeve about the pile based on the degraded condition.

5. The method of claim 1, further comprising:

installing a supplemental pile in addition to the pile; and coupling the supplemental pile to the sleeve that is installed about the pile at a non-zero angle relative to a coupling member between a structure and the sleeve padeye.

6. The method of claim 1, further comprising:

installing an anchoring member in addition to the pile; and coupling the anchoring member to the sleeve that is installed about the pile at a non-zero angle relative to a coupling member between a structure and the sleeve padeye.

7. The method of claim 1, further comprising locking the sleeve to the pile.

8. The method of claim 1, wherein the pile comprises a suction pile.

9. The method of claim 1, further comprising rehabilitating the pile by providing the pile with a greater ability to support a load compared to an ability of the pile without the sleeve installed.

10. The method of claim 1, further comprising rehabilitating the pile by positioning the sleeve so that the sleeve padeye is usable in place of the pile padeye.

11. The method of claim 1, further comprising replacing the sleeve.

12. The method of claim 1, further comprising rehabilitating the pile by substituting the sleeve for a portion of the pile that supports a load.

13. A rehabilitation system comprising an existing subsea pile having at least a portion of a pile padeye, the subsea pile installed into a sea floor and having a top portion;

a sleeve having an interior volume and an at least partially open bottom;

a sleeve padeye having a section of material coupled to an outer surface of the sleeve with an opening disposed through the section;

wherein the sleeve is configured to be installed about the existing subsea pile, and the sleeve padeye being configured to support a tension load at an angle to a longitudinal axis through the sleeve to supplement or replace a tension load on the pile padeye; and the sleeve being coupled to the pile so that the top portion of the pile is disposed within or above the interior volume of the sleeve and the sleeve padeye being aligned with the at least a portion of the pile padeye when the sleeve is coupled to the pile.

14. The system of claim 13, wherein the sleeve comprises an assembly of at least two rings coupled together with at least one longitudinal member, the rings being spaced apart from each other.

15. The system of claim 14, wherein the at least one longitudinal member extends outwardly from the at least two rings and is adapted to guide the sleeve in rotational alignment with the existing pile.

16. The system of claim 14, further comprising one or more intermediate rings coupled between the at least two rings and longitudinally spaced apart from each of the at least two rings.

17. The system of claim 14, wherein the sleeve comprises at least two longitudinal members spaced about a periphery of the rings.

18. The system of claim 13, wherein the sleeve padeye is an extended padeye having a clearance portion extending radially outwardly from an inner portion of the sleeve, the clearance portion being sized to clear an existing pile padeye on the pile.

19. The system of claim 13, further comprising a locking system adapted to couple the sleeve to the pile.

20. The system of claim 13, further comprising at least one secondary padeye disposed on the sleeve and rotationally located at a non-zero angle relative to the padeye of the sleeve.

21. The system of claim 20, wherein the secondary padeye is coupled to an anchor, a supplemental pile, or a combination thereof.

22. The system of claim 13, further comprising a supplemental pile coupled to the sleeve.

23. The system of claim 13, wherein the sleeve comprises at least one longitudinal member adapted to guide the sleeve in rotational alignment with the existing pile.

24. The system of claim 13, wherein the existing subsea pile has a first ability to support a load, and wherein once the sleeve is installed on the pile, the sleeve and pile collectively have a second ability to support a load, the second ability being greater than the first ability.

25. The system of claim 13, wherein the sleeve further comprises an uppermost top, and wherein when the sleeve is installed about the pile, the top portion of the pile can be disposed anywhere between the bottom and top of the sleeve.

* * * * *